US012729694B1

(12) United States Patent
Zhang

(10) Patent No.: US 12,729,694 B1
(45) Date of Patent: Sep. 8, 2026

(54) MOUNTING STRUCTURE FOR FAN BLADE

(71) Applicant: Shengnan Zhang, Jingmen (CN)

(72) Inventor: Shengnan Zhang, Jingmen (CN)

( * ) Notice: Subject to any disclaimer, the term of this patent is extended or adjusted under 35 U.S.C. 154(b) by 0 days.

(21) Appl. No.: 19/307,101

(22) Filed: Aug. 22, 2025

(51) Int. Cl.
*F04D 29/34* (2006.01)
*F04D 19/00* (2006.01)
*F04D 25/08* (2006.01)

(52) U.S. Cl.
CPC ..... *F04D 29/34* (2013.01); *F04D 19/002* (2013.01); *F04D 25/088* (2013.01)

(58) Field of Classification Search
CPC ..... F04D 29/322; F04D 29/34; F04D 25/088; F05D 2260/36; F05D 2260/37
See application file for complete search history.

(56) References Cited

U.S. PATENT DOCUMENTS 6,676,376 B2 * 1/2004 Kerr, Jr. ..... F04D 29/34 416/220 A
8,845,293 B1 * 9/2014 Lowe ..... F04D 25/088 416/205
10,502,228 B2 * 12/2019 Zauhar ..... F04D 29/34
10,578,121 B2 * 3/2020 Tang ..... F04D 25/088
11,761,454 B2 * 9/2023 Yao ..... F04D 25/088 416/244 R
12,173,889 B1 * 12/2024 Zhu ..... F04D 29/34
12,180,973 B1 * 12/2024 Chen ..... F04D 25/088
12,203,478 B1 * 1/2025 Guo ..... F04D 29/34
12,234,833 B2 * 2/2025 Botkin ..... F04D 19/002
12,264,686 B1 * 4/2025 Botkin ..... F04D 29/34
12,385,497 B1 * 8/2025 Liu ..... F04D 29/34
2023/0111026 A1 * 4/2023 Wang ..... F04D 29/34 416/210 R

* cited by examiner

*Primary Examiner* — Courtney D Heinle
*Assistant Examiner* — Cameron A Corday
(74) *Attorney, Agent, or Firm* — Jose Cherson Weissbrot

(57) ABSTRACT

The present application relates to a mounting structure for a fan blade. The mounting structure for the fan blade includes a motor housing, a fan blade and a fastener. A slot is provided in a lateral portion of the motor housing. The fan blade includes a blade root, and the blade root is inserted into the slot. A snap is provided on the motor housing, a snap groove is provided on the blade root, and when the blade root is in a state of being inserted into the slot, the snap is snap-fitted into the snap groove such that the fan blade is snap-fitted with the motor housing. The fastener is detachably connected to both the motor housing and the fan blade to securely connect the fan blade to the motor housing.

6 Claims, 5 Drawing Sheets

MOUNTING STRUCTURE FOR FAN BLADE

TECHNICAL FIELD

The present application relates to the technical field of fans, and in particular to a mounting structure for a fan blade.

BACKGROUND

At present, fan blades available on the market are generally installed by means of screw fastening. Such connection method requires special mounting tools (e.g., screwdrivers and wrenches) during installation, which increases the difficulty of installation. Moreover, during long-term operation of a fan, constant vibration of the fan may cause a screw to gradually loosen, and this problem is even more serious in a ceiling fan having a reverse function, posing potential safety hazards.

SUMMARY

An embodiment of the present application provides a mounting structure for a fan blade, including:

- a motor housing, a slot being provided in a lateral portion of the motor housing;
- a fan blade including a blade root, the blade root being inserted into the slot;
- a snap being provided on the motor housing, a snap groove being provided on the blade root, and when the blade root is in a state of being inserted into the slot, the snap being snap-fitted into the snap groove such that the fan blade is snap-fitted with the motor housing; and
- a fastener detachably connected to both the motor housing and the fan blade to securely connect the fan blade to the motor housing.

BRIEF DESCRIPTION OF THE DRAWINGS

In accompanying drawings, the same reference signs denote the same or similar components or elements throughout multiple drawings unless otherwise specified. These drawings are not necessarily drawn to scale. It should be understood that these drawings depict only some implementations according to the present application and should not be construed as limiting the scope of the present application.

LIST OF REFERENCE SIGNS

Figure 1:
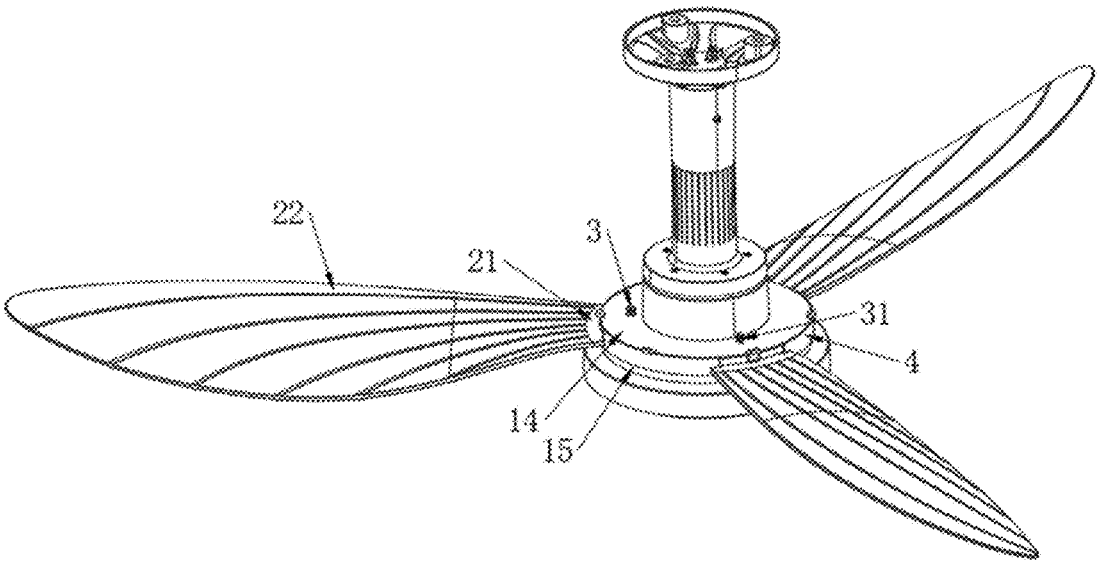
FIG. 1 is a structural schematic diagram of a fan lamp according to an embodiment of the present application.
Figure 2:
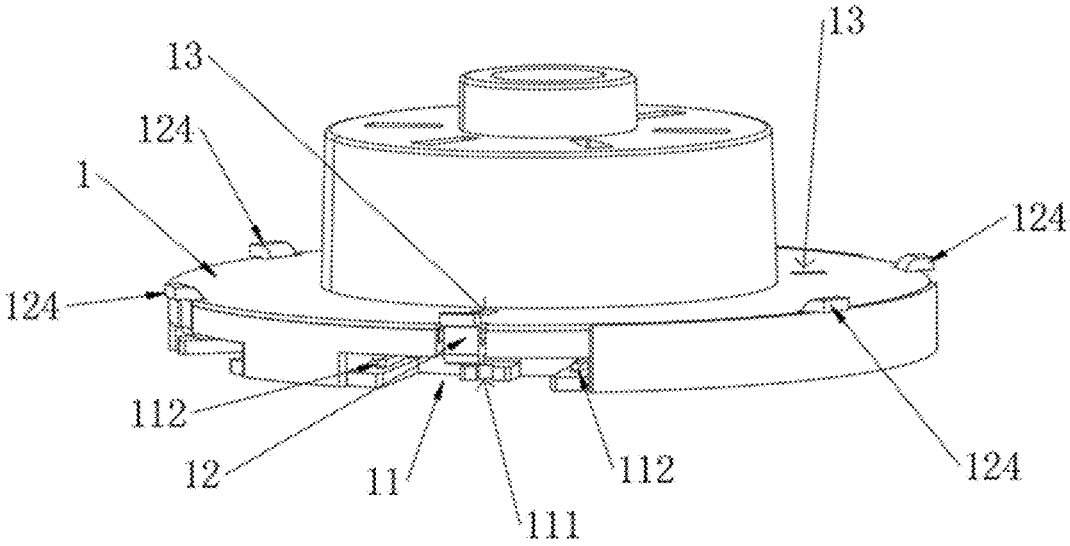
FIG. 2 is a structural schematic diagram of a motor housing according to an embodiment of the present application.
Figure 3:
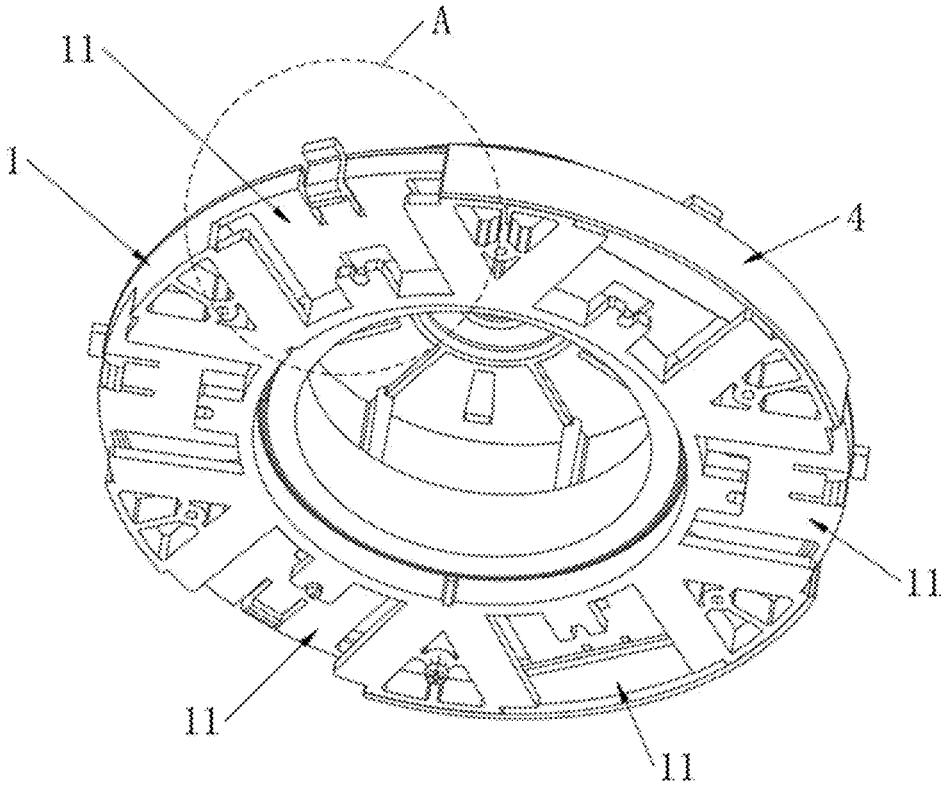
FIG. 3 is a structural schematic diagram of the motor housing shown in FIG. 2 from another perspective.
Figure 4:
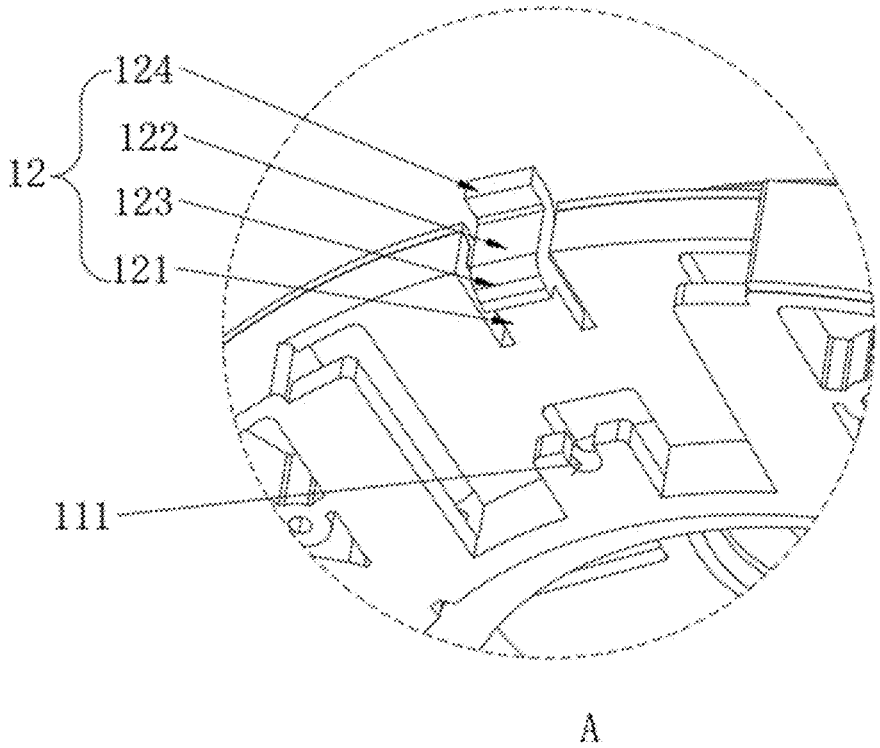
FIG. 4 is an enlarged schematic diagram of a structure at A of the motor housing shown in FIG. 3.
Figure 5:
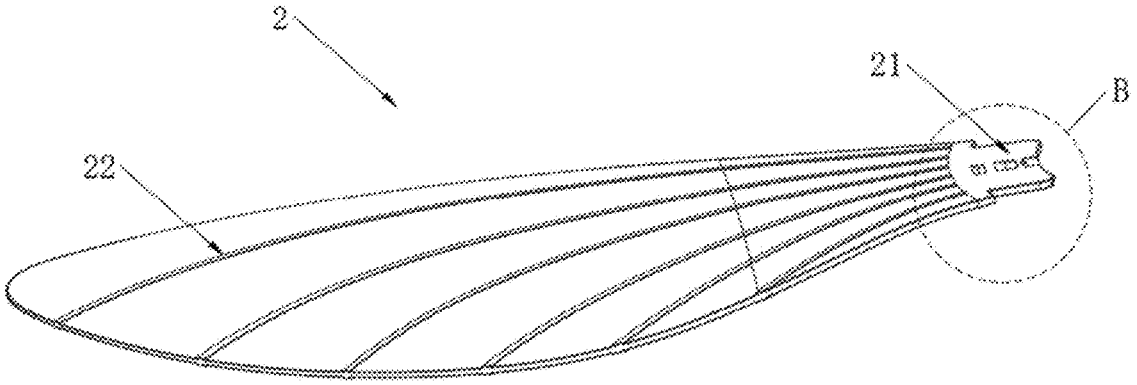
FIG. 5 is a structural schematic diagram of a fan blade according to an embodiment of the present application.

1. Motor housing; 11. Slot; 111. Fixing hole; 112. Guide rail; 12. Snap; 121. Transverse bar; 122. Longitudinal bar; 123. Snap point; 124. Protrusion point; 13. First pin hole; 14. Upper shell; 15. Lower shell; 2. Fan blade; 21. Blade root; 211. Snap groove; 212. Second pin hole; 213. Guide groove; 214. Slope surface; 215. Elongated groove; 22. Blade; 3. Fastener; 31. Bolt; 4. Decorating part.

DETAILED DESCRIPTION OF EMBODIMENTS

Various different implementations or embodiments carrying out the subject matter and technical solutions are disclosed as follows. To simplify the disclosure, specific examples of elements and arrangements will be described below. Of course, these examples are merely exemplary, and are not intended to limit the scope of protection of the present application. For example, a first feature recorded later in the specification being formed above or over a second feature can include an implementation of forming a direct contact of the first and second features, and can also include an implementation of forming an additional feature between the first feature and the second feature such that the first and second features may not be in direct contact. In addition, reference numerals and/or letters may be repeated in different examples in the disclosure. This repetition is for the sake of brevity and clarity, and does not itself represent the relationship between the various implementations and/or structures to be discussed. Further, when a first element is described as being connected or coupled to a second element, the description includes an implementation in which the first and second elements are directly connected or coupled to each other, and also includes an implementation in which the first and second elements are indirectly connected or coupled to each other by using one or more other intervening elements.

Only some exemplary embodiments are briefly described below. As can be appreciated by those skilled in the art, modifications may be made to the described embodiments in various ways without departing from the spirit or scope of the present application. Therefore, the accompanying drawings and the description are considered as exemplary in nature rather than limiting.

Referring to FIGS. 1 to 4, the present application provides a mounting structure for a fan blade 2. The mounting structure includes a motor housing 1, a fan blade 2 and a fastener 3. A slot 11 is provided in a lateral portion of the motor housing 1. The fan blade 2 includes a blade root 21, and the blade root 21 is inserted into the slot 11. A snap 12 is provided on the motor housing 1, a snap groove 211 is provided on the blade root 21, and when the blade root 21 is in a state of being inserted into the slot 11, the snap 12 is snap-fitted into the snap groove 211 such that the fan blade 2 is snap-fitted with the motor housing 1.

The fastener 3 is detachably connected to both the motor housing 1 and the fan blade 2 to securely connect the fan blade 2 to the motor housing 1. The motor housing 1 includes an upper shell 14 and a lower shell 15, the upper shell 14 covers the lower shell 15 to form a housing, and the slot 11 is provided in a lateral portion of the housing.

In the mounting structure for the fan blade 2 according to the present application, the slot 11 is provided in the lateral portion of the motor housing 1, the blade root 21 of the fan blade 2 is inserted into the slot 11, and the snap 12 on the motor housing 1 is snap-fitted into the snap groove 211 provided on the blade root 21, so as to realize the snap-fixing between the blade root 21 and the motor housing 1; and the fan blade 2 and the motor housing 1 are then further securely connected by means of the fastener 3. Such an arrangement enables a very secure connection between the fan blade 2 and the motor housing 1, thereby effectively preventing the fan blade 2 from loosening or falling off during long-term use of a fan and thus ensuring the stability and safety of use. When disassembling the fan blade 2, the fan blade 2 can be removed from the slot 11 of the motor housing 1 only by detaching the fastener 3 and then applying a force to the snap 12 to separate the snap 12 from the snap groove 211. Thus, the assembly and disassembly of the fan blade 2 are relatively simple and convenient.

Referring to FIGS. 2 to 4 and 7 to 10, in some embodiments, the snap 12 is L-shaped, the snap 12 includes a transverse bar 121 and a longitudinal bar 122 connected to the transverse bar 121, one end of the transverse bar 121 is fixed to the motor housing 1, the other end of the transverse bar 121 and one end of the longitudinal bar 122 are perpendicularly connected to form an L shape, a snap point 123 is formed at a joint of the transverse bar 121 and the longitudinal bar 122, and the snap point 123 is snap-fitted into the snap groove 211, so as to realize the snap-fixing between the blade root 21 and the motor housing 1.

Further, referring to FIGS. 1 to 4, the snap 12 further includes a protrusion point 124, and the protrusion point 124 is arranged at an end of the longitudinal bar 122 away from the transverse bar 121. The protrusion point 124 is exposed, i.e., extends from the motor housing 1, which facilitates force application thereto by a user. Specifically, when disassembling the fan blade 2, the fan blade 2 can be removed from the slot 11 of the motor housing 1 only by first detaching the fastener 3 and then applying a force to the protrusion point 124 by the user to separate the snap point 123 of the snap 12 from the snap groove 211. Thus, the assembly and disassembly of the fan blade 2 are relatively simple and convenient.

Referring to FIGS. 1 to 4, in some embodiments, the fastener 3 is a bolt 31, a first pin hole 13 is provided in the motor housing 1, a second pin hole 212 is provided in the blade root 21, and the bolt 31 passes through the first pin hole 13 and the second pin hole 212 in sequence to securely connect the fan blade 2 to the motor housing 1. The use of a bolt 31 as the fastener 3 helps to reinforce the secure connection between the fan blade 2 and the motor housing 1. Such an arrangement enables a very secure connection between the fan blade 2 and the motor housing 1, thereby effectively preventing the fan blade 2 from loosening or falling off during long-term use of the fan and thus ensuring the stability and safety of use. It will be understood that in addition to using the bolt 31, the fastener 3 may also be other parts such as a screw.

Referring to FIGS. 2 to 6, in some embodiments, a guide groove 213 is provided on the blade root 21, and the guide groove 213 is located between the snap groove 211 and the second pin hole 212 for guiding the snap 12 into the snap groove 211. The snap point 123 of the snap 12 may easily slide into the snap groove 211 under the guidance of the guide groove 213 when the fan blade 2 is inserted into the slot 11, so that the process of snap-fitting between the snap 12 and the snap groove 211 is smoother and more labor-saving. Further, a slope surface 214 is provided on the blade root 21, and the second pin hole 212 is provided in the slope surface 214. The snap point 123 of the snap 12 slides into the snap groove 211 under the guidance of the slope surface 214 and the guide groove 213 when the fan blade 2 is inserted into the slot 11, so that the process of snap-fitting between the snap 12 and the snap groove 211 is smoother and more labor-saving.

Referring to FIGS. 1 to 4, in some embodiments, a fixing hole 111 for fixing the bolt 31 is provided in a bottom of the slot 11, and the bolt 31 is inserted into the fixing hole 111 after passing through the first pin hole 13 and the second pin hole 212. Specifically, the fixing hole 111 is a U-shaped hole for limiting the bolt 31 to prevent the bolt 31 from shaking, thereby improving the stability of connection between the fan blade 2 and the motor housing 1. It will be understood that the fixing hole 111 may also be configured as a pin hole or a screw hole for further fixing the bolt 31 and preventing the bolt 31 from falling off.

Figure 6:
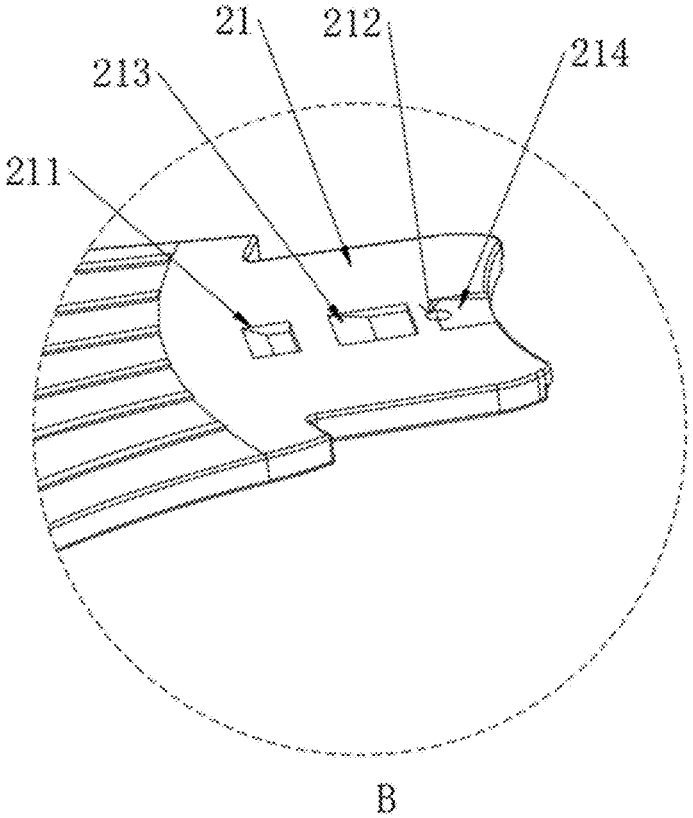
FIG. 6 is an enlarged schematic diagram of a structure at B of the fan blade shown in FIG. 5.
Figure 7:
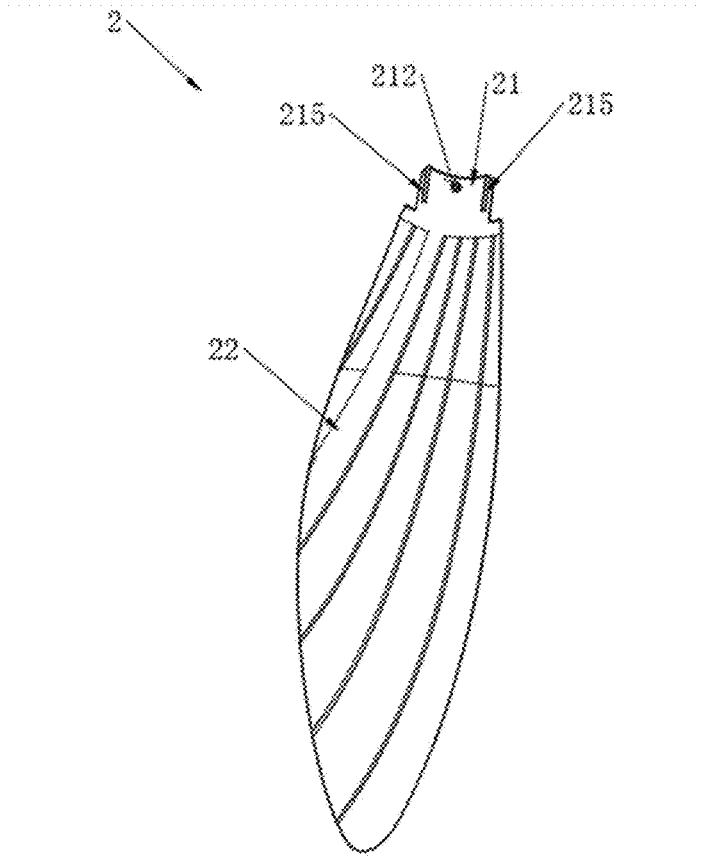
FIG. 7 is a structural schematic diagram of the fan blade according to an embodiment of the present application from another perspective.
Figure 8:
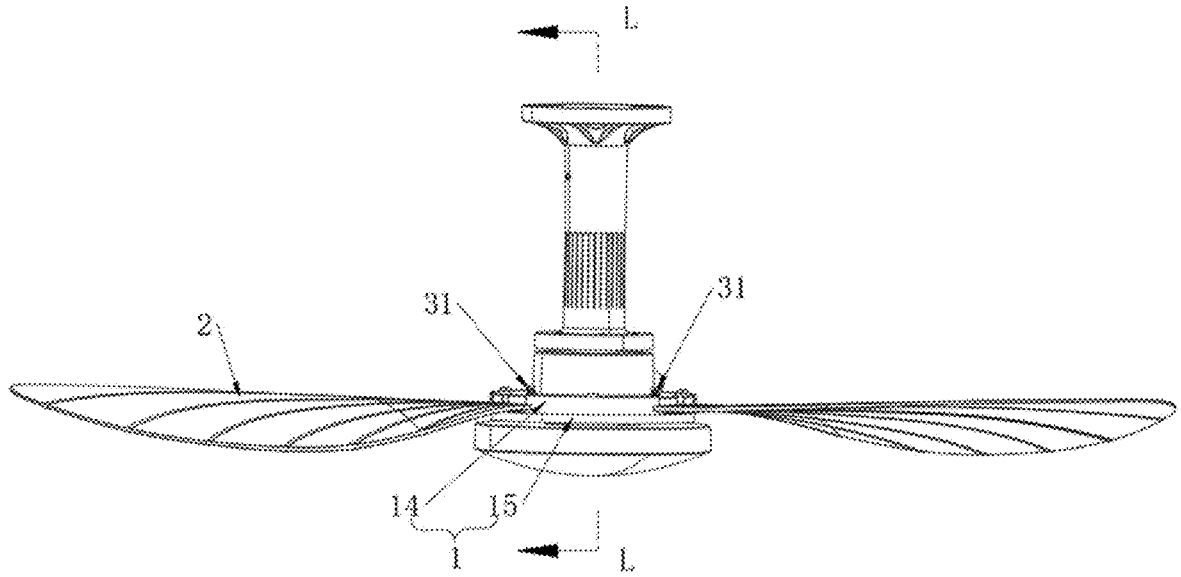
FIG. 8 is a structural schematic diagram of a fan lamp according to an embodiment of the present application.
Figure 9:
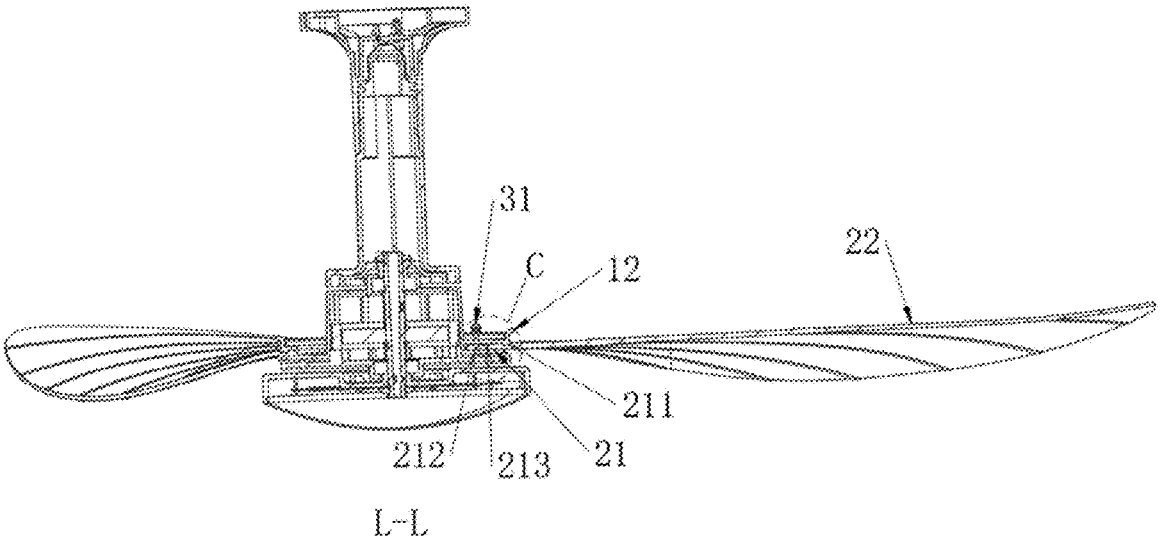
FIG. 9 is a schematic diagram of a sectional structure of the fan lamp shown in FIG. 8 along line L-L.
Figure 10:
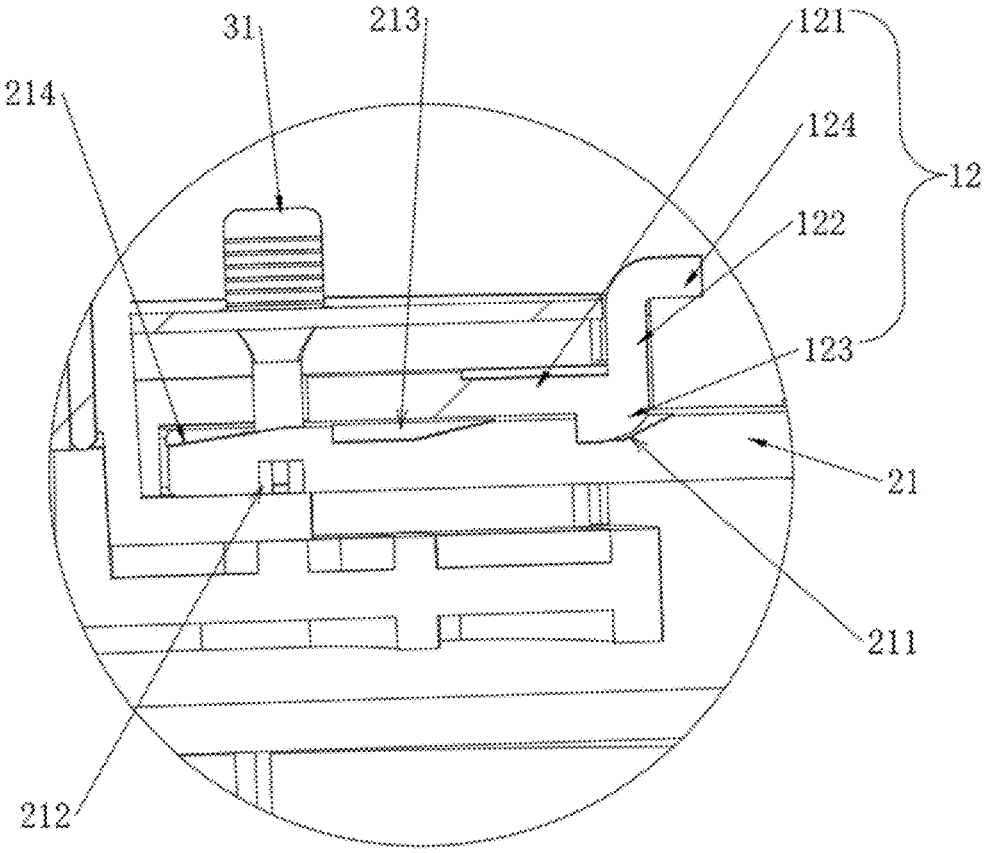
FIG. 10 is an enlarged schematic diagram of a structure at C of the fan lamp shown in FIG. 9.

Referring to FIGS. 6 to 7, in some embodiments, an elongated groove 215 is provided on the blade root 21, a guide rail 112 is provided on an inner wall of the slot 11, the guide rail 112 matches the elongated groove 215, and the guide rail 112 is slidably arranged inside the elongated groove 215. Such a design helps the fan blade 2 to be accurately inserted into a fixed position inside the snap groove 211 each time, without positional deviation.

Referring to FIGS. 1 to 10, in some embodiments, there are three slots 11 evenly distributed on a periphery of the motor housing 1, there are three fan blades 2, and the fan blades 2 and the slots 11 are arranged in a one-to-one correspondence. It will be understood that there may be other numbers of fan blades 2, such as four and five, and the number of slots 11 is equal to the number of fan blades 2 or the number of slots 11 is greater than the number of fan blades 2, so that the user can insert the fan blades 2 into some of the slots 11 at his/her own discretion. In some embodiments, the motor housing 1 further includes a decorating part 4 for closing the slot 11, and the decorating part 4 is of a sheet-like structure and may be directly inserted into the slot 11 where no fan blade 2 is inserted, so as to prevent dust from falling into the slot 11 and also serve an aesthetic purpose.

Referring to FIGS. 1 to 10, in some embodiments, the fan blade 2 includes a blade 22, the blade 22 is connected to the blade root 21, and the blade 22 has a shape consistent with that of a cicada wing. Designing the blade 22 in the shape of the cicada wing helps to increase the air flow.

The above technical solution has at least the following advantages or beneficial effects.

In the mounting structure for the fan blade 2 according to the present application, the slot 11 is provided in the lateral portion of the motor housing 1, the blade root 21 of the fan blade 2 is inserted into the slot 11, and the snap 12 on the motor housing 1 is snap-fitted into the snap groove 211 provided on the blade root 21, so as to realize the snap-fixing between the blade root 21 and the motor housing 1; and the fan blade 2 and the motor housing 1 are then further securely connected by means of the fastener 3. Such an arrangement enables a very secure connection between the fan blade 2 and the motor housing 1, thereby effectively preventing the fan blade 2 from loosening or falling off during long-term use of a fan and thus ensuring the stability and safety of use. When disassembling the fan blade 2, the fan blade 2 can be removed from the slot 11 of the motor housing 1 only by detaching the fastener 3 and then applying a force to the snap 12 to separate the snap 12 from the snap groove 211. Thus, the assembly and disassembly of the fan blade 2 are relatively simple and convenient.

In the mounting structure for the fan blade 2 according to the present application, the guide groove 213 is provided at the blade root 21, and the snap point 123 of the snap 12 may easily slide into the snap groove 211 under the guidance of the guide groove 213 when the fan blade 2 is inserted into the slot 11, so that the process of snap-fitting between the snap 12 and the snap groove 211 is smoother and more labor-saving.

In the mounting structure for the fan blade 2 according to the present application, the slope surface 214 is provided on the blade root 21, and the snap point 123 of the snap 12 slides into the snap groove 211 under the guidance of the slope surface 214 and the guide groove 213 when the fan blade 2 is inserted into the slot 11, so that the process of snap-fitting between the snap 12 and the snap groove 211 is smoother and more labor-saving.

In the mounting structure for the fan blade 2 according to the present application, the elongated groove 215 is provided on the blade root 21, the guide rail 112 is provided on the inner wall of the slot 11, and the guide rail 112 matches the elongated groove 215, which helps the fan blade 2 to be accurately inserted into the fixed position inside the snap groove 211 without positional deviation.

In the description of this specification, descriptions with reference to the terms such as "an embodiment", "some embodiments", "example", "specific example", or "some examples" mean that specific features, structures, materials, or characteristics described with reference to the embodiment or example are included in at least one embodiment or example of the present application. Moreover, the specific features, structures, materials or characteristics described can be combined in any one or more embodiments or examples in any suitable manner. In addition, without any contradiction, those skilled in the art may incorporate and combine different embodiments or examples and features of the different embodiments or examples described in this specification.

In addition, the terms "first" and "second" are merely used for the purpose of illustration, and cannot be construed as indicating or implying relative importance or implicitly indicating the number of technical features indicated. Thus, the features defined with "first" and "second" may explicitly or implicitly include at least one of the features. In the description of the present application, the meaning of "a plurality of" is two or more, unless explicitly and specifically defined otherwise.

The above description is merely specific implementations of the present application, but is not intended to limit the scope of protection of the present application. Any variation or replacement readily figured out by a person skilled in the art within the technical scope disclosed in the present application shall fall within the scope of protection of the present application. Therefore, the scope of protection of the present application shall be subject to the scope of protection of the claims.

What is claimed is:

1. A fan blade mounting structure, comprising:

a motor housing, comprising:

a lower shell having at least one fixing hole, an upper shell covering the lower shell to form at least one housing, wherein at least one slot is provided in a lateral portion of the at least one housing and at least one first pin hole is provided in the upper shell of the motor housing such that the at least one fixing hole provided in a bottom of the slot is aligned with the at least one first pin hole, and at least one snap integrally formed at a circumferential edge of the upper shell of the motor housing and positioned at an opening of the at least one slot, wherein the at least one snap, configured for up and down displacement for engagement and disengagement of the at least one fan blade and the motor housing, includes:

a transverse bar, a longitudinal bar connected to the transverse bar, wherein one end of the transverse bar is integrally fixed to the motor housing and another end of the transverse bar and one end of the longitudinal bar are perpendicularly connected, a snap point downwardly formed at a joint of the transverse bar and the longitudinal bar, and a protrusion point integrally arranged at a free end of the longitudinal bar and extended upwards away from the transverse bar, such that the protrusion point is extended and exposed on top of the motor housing;

at least one fan blade having a blade root sized and shaped to be received in the at least one slot, wherein the blade root has:

a snap groove, provided on the blade root, being sized and shaped for the at least one snap being snap-fitted therein so as to snap-fixing between the blade root and the motor housing, a slope surface provided on a free end of the blade root of the at least one fan blade, a second pin hole provided in the slope surface and aligned with the at least one first pin hole and the at least one fixing hole, and a guide groove, provided on the blade root, being located between the snap groove and the second pin hole and configured for guiding the at least one snap to snap-fitting into the at least one snap groove under a guidance of the slop surface and the guide groove, such that when the at least one fan blade is inserted in the at least one slot, the at least one snap undergoes a temporary displacement to allow the snap point of the at least one snap to ride over the slope surface and pass the guide groove to fittingly slide into the snap groove, and at least one fastener configured to pass through the first pin hole and the second pin hole and then insert into the at least one fixing hole so as to be fixed and limited by the at least one fixing hole in sequence, so as to securely connect and assemble the at least one fan blade and the motor housing, wherein the at least fan blade is capable of being removed from the at least one slot of the motor housing by detaching the at least one fastener and then applying a force to the protrusion point to separate the snap point of the at least one snap from the snap groove of the at least one fan blade so as to disassemble the at least one fan blade from the motor housing.

2. The fan blade mounting structure, as recited in claim 1, wherein the at least one fixing hole is selected from a group consisting of a U-shaped hole, a pin hole and a screw hole for fixing the fastener and limiting of the fastener to prevent the at least one fastener from shaking.

3. The fan blade mounting structure, as recited in claim 1, wherein the at least one fastener is selected from a group consisting of a bolt and a screw.

4. The fan blade mounting structure, as recited in claim 1, wherein a pair of elongated grooves are provided on two opposing sides of the blade root of the at least one fan blade, and that a pair of guide rails are provided on two opposing inner walls of the at least one slot and configured to fittingly and slidingly inserted inside the pair of elongated grooves respectively, so as to ensure the at least one fan blade to be accurately inserted into a fixed position inside the snap groove without positional deviation.

5. The fan blade mounting structure, as recited in claim 1, wherein the motor housing further includes at least one decorating part configured to directly inserted into the at least one slot for closing the at least one slot where no fan blade is inserted.

6. The fan blade mounting structure, as recited in claim 5, wherein the motor housing further includes at least one decorating part configured to directly inserted into the at least one slot for closing the at least one slot where no fan blade is inserted.

* * * * *